US010472853B2

(12) United States Patent
Shah et al.

(10) Patent No.: US 10,472,853 B2
(45) Date of Patent: Nov. 12, 2019

(54) BREAK AWAY LATCH HANDLE

(71) Applicant: ARCHITECTURAL BUILDERS HARDWARE MFG., INC., Itasca, IL (US)

(72) Inventors: Ankit Kirti Shah, Chicago, IL (US); Darryl Devine, Huntley, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 589 days.

(21) Appl. No.: 15/090,750

(22) Filed: Apr. 5, 2016

(65) Prior Publication Data

US 2017/0284125 A1 Oct. 5, 2017

(51) Int. Cl.
*E05B 7/00* (2006.01)
*E05C 1/14* (2006.01)

(52) U.S. Cl.
CPC . *E05B 7/00* (2013.01); *E05C 1/14* (2013.01)

(58) Field of Classification Search
CPC ..... Y10T 292/57; Y10T 292/0971; Y10T 292/0986; E05B 7/00; E05B 1/0007; E05B 1/00; E05B 1/0061; E05B 2001/0076; E05C 1/14
See application file for complete search history.

(56) References Cited

U.S. PATENT DOCUMENTS 4,003,593 A * 1/1977 Wilzig ..... E05B 65/104 292/165
4,629,228 A * 12/1986 Marko ..... E05B 7/00 292/165
4,785,286 A 11/1988 Martin
5,072,977 A * 12/1991 Millman ..... E05B 63/04 292/172
5,730,478 A 3/1998 D'Hooge
6,196,599 B1 3/2001 D'Hooge
6,293,598 B1 9/2001 Rusiana
6,412,834 B1 7/2002 Waitai et al.
6,784,784 B1 8/2004 Zehrung
7,258,374 B2 * 8/2007 Rusiana ..... E05C 1/14 292/244
7,481,607 B2 * 1/2009 Rusiana ..... B23B 47/287 408/115 R
9,039,051 B2 * 5/2015 Shen ..... E05B 7/00 292/336.3
9,359,797 B2 * 6/2016 Shen ..... E05C 1/14
9,605,443 B2 * 3/2017 Shah ..... E05B 7/00
(Continued)

FOREIGN PATENT DOCUMENTS

DE 3818187 C1 8/1989
DE 19930690 A1 1/2001
WO 2006/074967 A1 7/2006

*Primary Examiner* — Mark A Williams
(74) *Attorney, Agent, or Firm* — Greer, Burns & Crain, Ltd.

(57) ABSTRACT

A door handle assembly for use with a door that includes an actuator plate configured for activating a door latch assembly and a door handle having a working end pivotally connected to the actuator plate and a free end opposite of the working end configured for manipulation by an operator, where the door handle freely pivots between a up position and down position relative to the actuator plate and only activates the latch assembly in the down position.

15 Claims, 8 Drawing Sheets

(56) References Cited

U.S. PATENT DOCUMENTS

| | | | | |
|---|---|---|---|---|
| 9,765,549 | B2 * | 9/2017 | Shah | E05B 63/0056 |
| 9,828,793 | B2 * | 11/2017 | Shah | E05C 1/14 |
| 9,890,569 | B2 * | 2/2018 | Shah | E05C 1/14 |
| 2010/0101149 | A1 | 4/2010 | Keller | |
| 2010/0126239 | A1 | 5/2010 | Berger | |
| 2011/0016971 | A1 | 1/2011 | Yulkowski et al. | |
| 2011/0068927 | A1 | 3/2011 | Berger | |
| 2012/0073084 | A1 * | 3/2012 | Lin | E05B 3/00 16/412 |
| 2013/0076046 | A1 * | 3/2013 | Shah | E05B 63/0056 292/336.3 |
| 2015/0211253 | A1 * | 7/2015 | Shah et al. | |

* cited by examiner

BREAK AWAY LATCH HANDLE

BACKGROUND

The present invention relates generally to push/pull type door latch assemblies that include paddle style handles. More specifically, the present handle assembly freely pivots when pulled, and only operates the corresponding door latch by a pushing action.

Door latches keep a door from opening until an operator disengages the door latch bolt by maneuvering one of the handles. Rotating knob, lever, and push/pull paddle type door handles are known in the art. Because no rotational movement is required to operate push/pull door handles, these handles are commonly used in health care and education facilities such as hospitals, nursing homes and schools. A desirable feature of push/pull door handles is that they allow easy, hands-free opening of a door.

Handle assemblies conventionally include base plates, paddle style handle levers, springs, pins and fasteners. Known paddle style push/pull handle assemblies, are disclosed in U.S. Pat. Nos. 5,730,478; 6,196,599 and 6,293,598, all of which are incorporated by reference.

In conventional applications, a pull handle of a door latch assembly is mounted on the side of the door toward which the door opens into a room interior, and a push handle of the door latch assembly is mounted on the opposite side of the door. These assemblies typically incorporate a handle having a projection such as a finger or the like, that upon movement of the handle, actuates a cam which transfers motion from the pushing or pulling movement of the handle to rotate a drive shaft extending through an opening in a latch cylinder. When rotated, the drive shaft withdraws the door latch, against the force of a return spring, to release the door. Generally, only a small amount of force in one direction is sufficient to release the latch.

Conventional door handle assemblies include a door handle having an integrally formed actuator part that rotates in unison with the handle to rotate the drive shaft. The actuator part is located within a housing or cover that encloses the parts of door handle assembly, with only the handle extending outside of the housing. As such, the rotation of the actuator part and thereby the door handle is limited by the inner surfaces of the housing that are above and below the actuator part. The limited movement of the door handle is an issue in that clothing, bags and other loose articles can become snagged on the door handle and damage the snagged article. Accordingly, there is a need for a door handle assembly that addresses this problem.

SUMMARY

This and other problems of conventional push/pull door handle assemblies are addressed by the present door handle assembly. An actuator plate is mounted to a base, and then a handle is pivotably connected to the actuator plate so that the pivot point of the handle is spaced from the base. Spacing the pivot point of the handle from the base enables the handle to freely pivot relative to the base as well as to a cover plate enclosing the base between an up position and a down position. This construction inhibits snagging of clothing or other items on the handle, and helps to release such items that may become snagged or caught on the handle.

In one embodiment, a door handle assembly for use with a door is provided, and includes an actuator plate configured for activating a door latch assembly and a door handle having a working end pivotally connected to the actuator plate, and a free end opposite of the working end configured for manipulation by an operator. The door handle freely pivots between an up position and a down position relative to the actuator plate and only activates the door latch assembly in the down position.

Another embodiment of the present door handle assembly is provided and includes a cover having a front opening, an actuator plate mounted inside the cover and positioned adjacent to the front opening. The actuator plate is configured for activating a door latch assembly. A door handle has a working end pivotally connected to the actuator plate, and a free end opposite of the working end configured for manipulation by an operator. The door handle freely pivots between an up position and a down position relative to the actuator plate and only activates the door latch assembly in the down position.

In another embodiment, a door handle assembly is provided for use in operating a door latch in a door, and includes a base having a flat plate and a pair of forwardly projecting arms, each arm having a mounting aperture. An actuator plate is mountable between the arms and having fastener openings engaging the mounting apertures, and the actuator plate is configured for activating the door latch. A door handle has a working end pivotally connected to the actuator plate at a pivot point displaced from the fastening openings, and a free end opposite of the working end configured for manipulation by an operator. The door handle freely pivots between an up position and a down position relative to the actuator plate and only activates the latch assembly in the down position.

DETAILED DESCRIPTION

Figure 1:
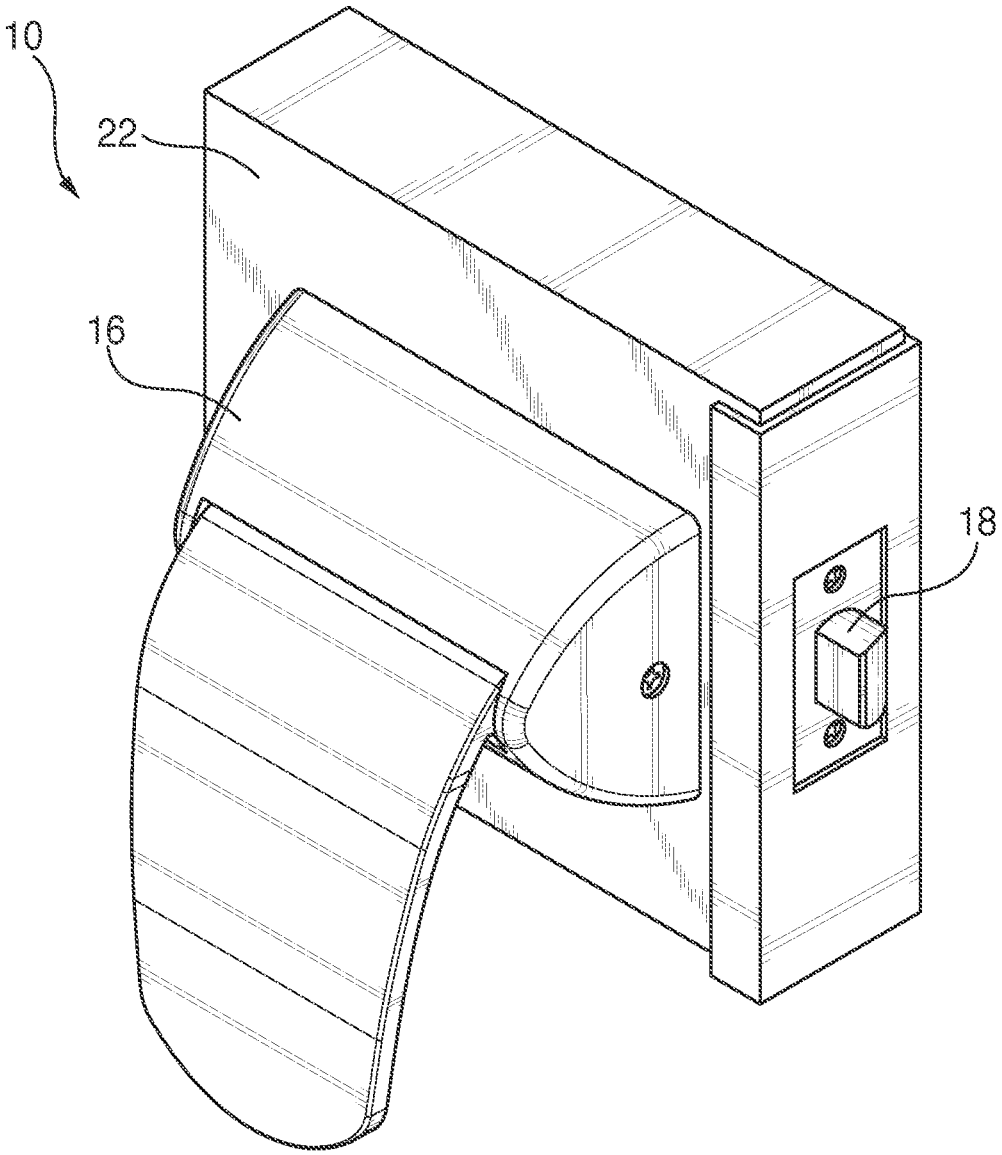
FIG. 1 (PRIOR ART)
FIG. 1 is a perspective view of a handle assembly in the prior art.

Referring to FIG. 1, one part of a handle assembly generally designated 10 is visible to an operator and is commonly known as the handle 12, while the other part, namely the pivot member 14, is not generally visible when assembled, but extends into the inner mechanism of a housing or cover 16 associated with the latch assembly and operates as an actuator of a cam assembly that is responsible for engagement with, and actuation of a locking bolt or latch 18.

Referring now to FIGS. 2A-6D, the present door handle assembly is generally designated 20 and is configured for use with a door 22. As shown in FIGS. 2A-2C, 3A-3C and 4, a paddle-style push/pull door handle 24 is pivotably connected to an actuator plate 26 at a pivot point represented by one or more pins 28 and freely pivots relative to the actuator plate and a handle cover 30 having an upper edge 30*a* and a lower edge 30*b* between a down position (FIGS. 2A-2C) and an up position (FIGS. 3A-3C). Free rotation or pivoting of the door handle 24 enables clothing and other articles to readily be released from the handle when the clothing and articles become snagged on or caught on the door handle during use.

Figure 2A:
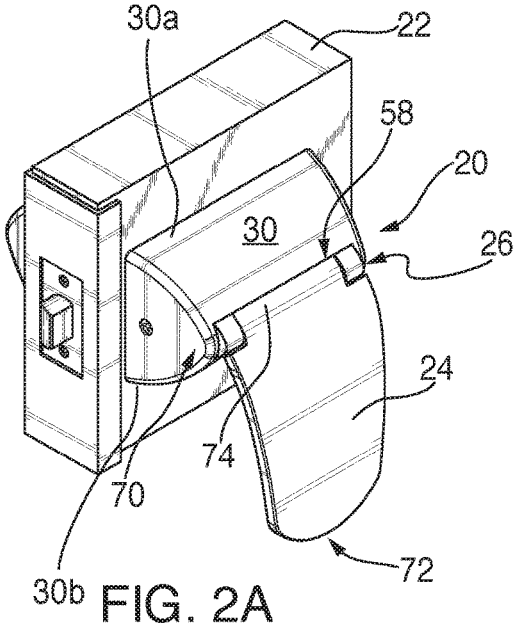
FIG. 2A is a perspective view of the present handle assembly where the handle is in the down position.
Figure 2B:
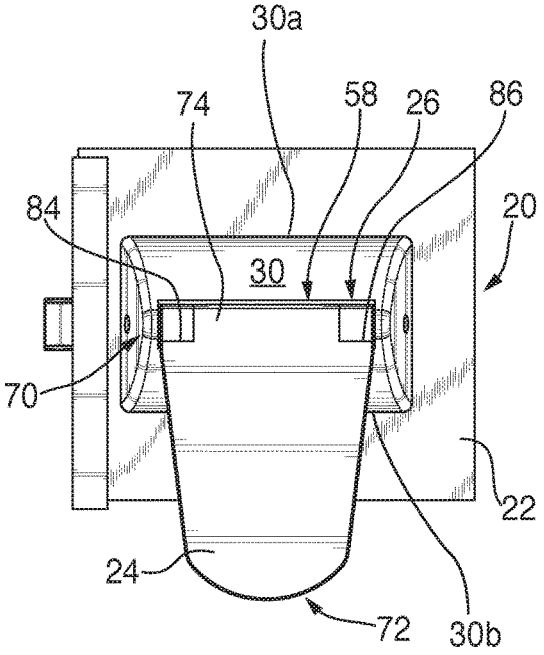
FIG. 2B is a front view of the handle assembly of FIG. 2A.
Figure 2C:
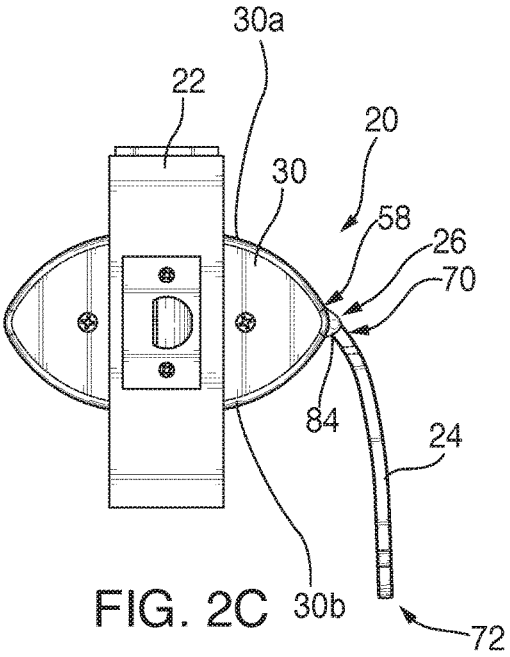
FIG. 2C is a side view of the handle assembly of FIG. 2A.
Figure 3A:
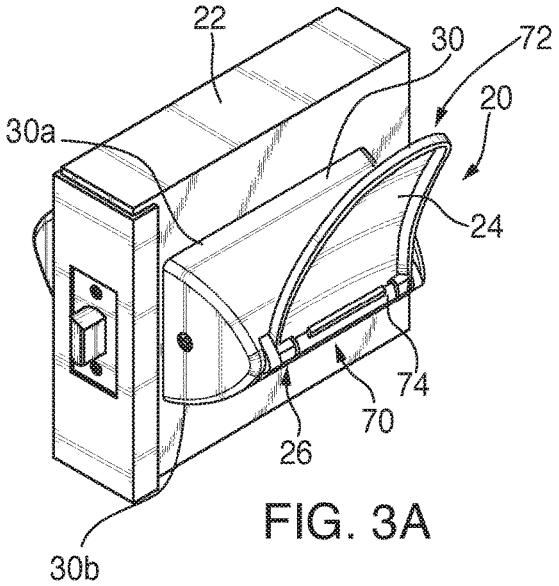
FIG. 3A is a perspective view of the present handle assembly where the handle is in the up position.
Figure 3B:
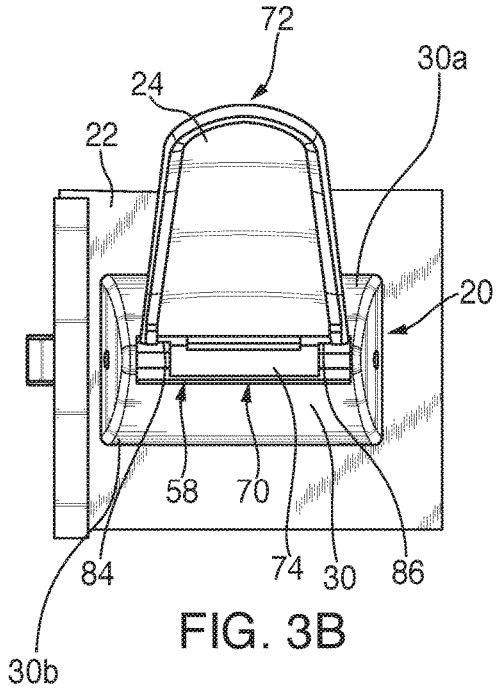
FIG. 3B is a front view of the handle assembly of FIG. 3A.
Figure 3C:
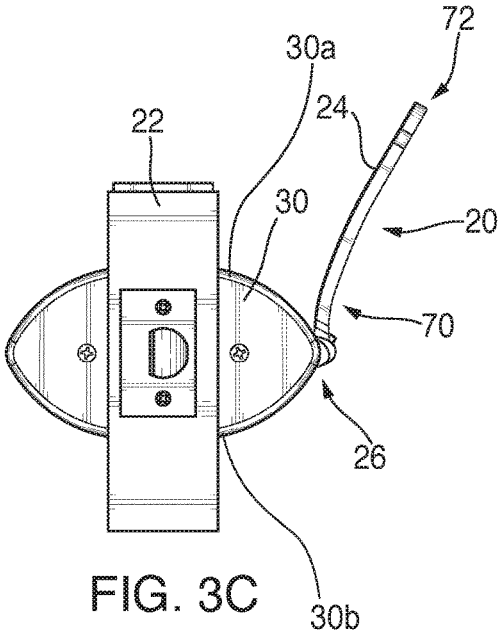
FIG. 3C is a side view of the handle assembly of FIG. 3C.
Figure 4:
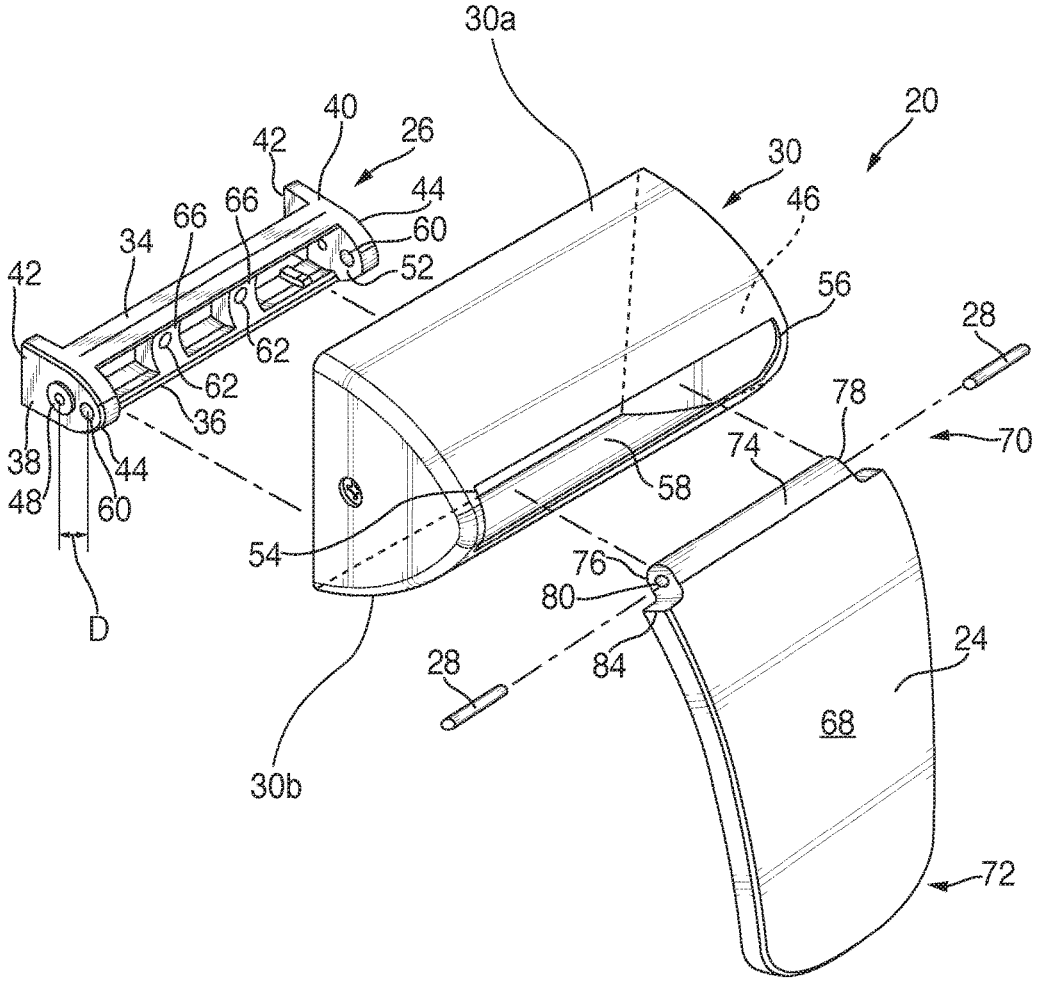
FIG. 4 is an exploded perspective view of the handle assembly of FIG. 2A.
Figure 5A:
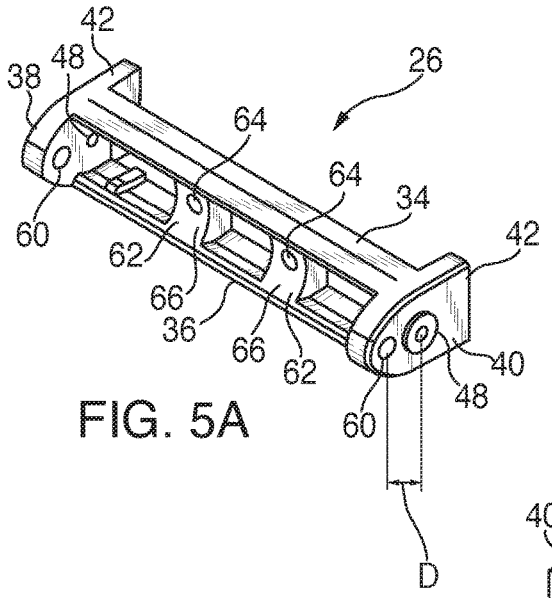
FIG. 5A is a front perspective view of an actuator plate of the handle assembly of FIG. 2A.
Figure 5B:
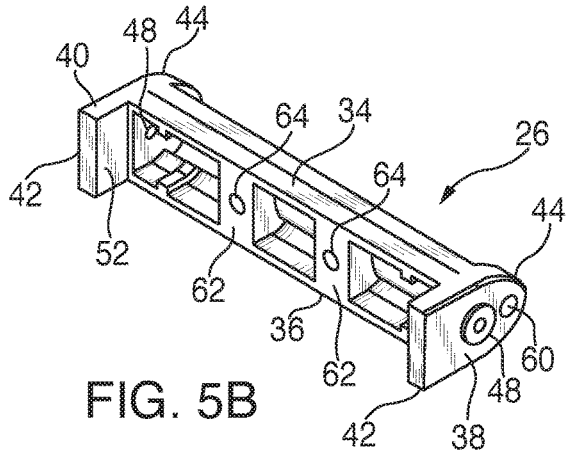
FIG. 5B is a rear perspective view of the actuator plate of FIG. 5A.
Figure 5C:
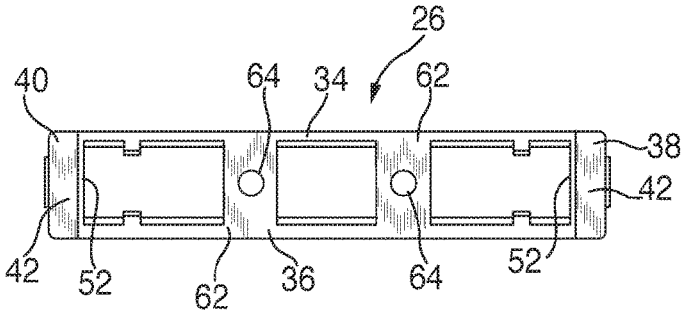
FIG. 5C is a rear view of the actuator plate of FIG. 5A.
Figure 5D:
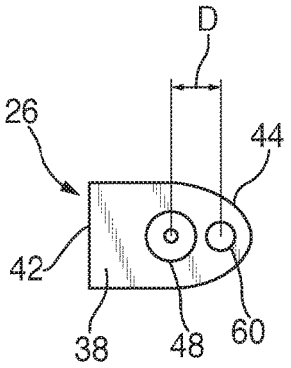
FIG. 5D is a side view of the actuator plate of FIG. 5A.

Referring now to FIGS. 4, 5A, 5B, 5C and 5D, the actuator plate 26 includes first and second spaced apart, elongate, parallel body members 34, 36 that extend between opposing mounting tabs 38, 40. Each mounting tab 38, 40 is oriented preferably perpendicularly to the body members 34, 36 and includes a rear portion 42 that extends inwardly within the cover 30 and a rounded, front protruding portion 44. The front protruding portion has a generally tapered or pointed shape that substantially matches the shape of a corresponding inner surface 46 of the cover. As shown in FIG. 4, the actuator plate 26 is positioned in the interior of the cover 30 and secured to a base 47 (FIG. 7) by inserting fasteners, such as screws, through fastener openings 48 formed in each of the mounting tabs 38, 40. As is known in the art, the cover 30 is secured to the base using fasteners 49 engaging base tabs 49' (FIG. 8). Each fastener extends through the fastener opening 48 in each of the mounting tabs 38, 40 from an inside surface 52 of the mounting tabs 38, 40 into the corresponding portion of the base 47. Once the actuator plate 26 is secured to the base 47, the mounting tabs 38, 40 are located adjacent to each corresponding end 54, 56 of a slot opening 58 in the cover. In addition, as seen in FIGS. 2C and 3C, the tabs 38, 40, and specifically, the front ends 44 project a sufficient distance outwardly from the cover 22 to enhance free upward pivoting action of the handle 24. As shown in FIGS. 4 and 5D, a pivot through-hole 60 is formed in the front portion 48 of each of the mounting tabs 38, 40, which enables the handle 24 to be pivotably secured to the actuator plate 26 as described in detail below.

In the illustrated embodiment of the actuator plate 26, a pair of supports 62 extend generally vertically between the spaced, parallel body members 34. The supports 62 are laterally spaced from each other and each include a central through-hole 64. A cam (not shown) is attached to one or both of the through-holes 64 in the supports 62 and is configured to engage a drive shaft that releases a latch associated with the door handle assembly. A suitable cam is described in commonly-assigned U.S. patent application Ser. No. 13/347,433, Publication No. 2013/0076046 A1, incorporated by reference. It is contemplated that the actuator plate 26 may have one or a plurality of the supports 62 for securing the cam in different, distinct positions between the mounting tabs 38, 40. Also, it should be appreciated that the supports 62 may be in any suitable position between the mounting tabs 38, 40. As shown in FIG. 5A, a front surface 66 of each support 62 is curved or concave and is configured to receive the correspondingly-shaped outer surface 68 of the handle 24 so that the handle freely pivots relative to the actuator plate 26.

Figure 6A:
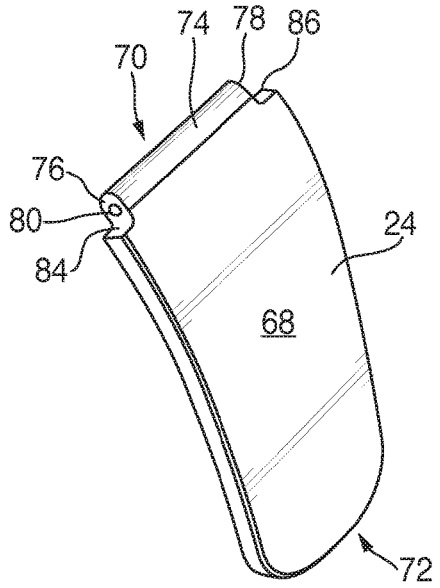
FIG. 6A is a perspective view of the present handle of the handle assembly of FIG. 2A.
Figure 6B:
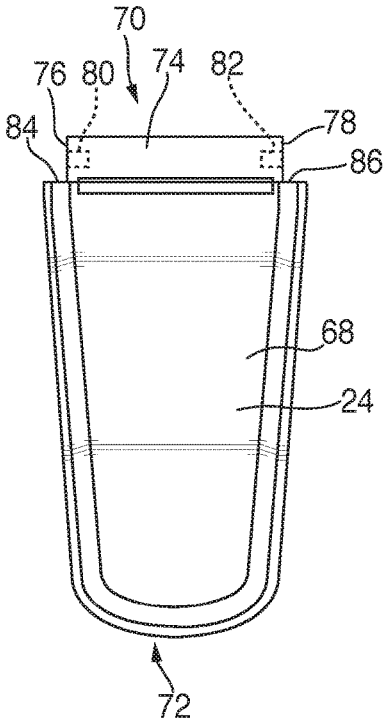
FIG. 6B is rear view of the handle of FIG. 6A.
Figure 6C:
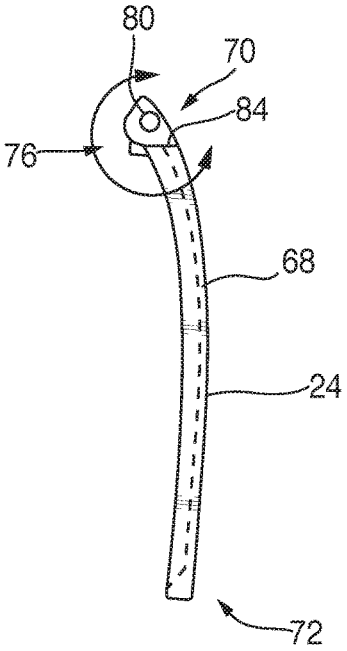
FIG. 6C is a side view of the handle of FIG. 6A.

Referring now to FIGS. 6A, 6B and 6C, the door handle 24 includes a body 68 having a first end or working end 70 and an opposing second end or free end 72 where the body is preferably outwardly curved from the first end towards the second end. It should be appreciated that the handle 24 may be any suitable shape or combination of shapes. To connect the handle 24 to the actuator plate 26, the first end 70 of the handle includes a central protruding portion 74 that has a width that is less than a width of the space between the mounting tabs 38, 40 on the actuator plate 26 so that the protruding portion can be inserted between the mounting tabs. Each side 76, 78 of the protruding portion 74 includes a cylindrical receptacle 80, 82 that is aligned with a corresponding one of the pivot through-holes 60 in the mounting tabs 38, 40 when the protruding portion is inserted between the mounting tabs.

Once the receptacles 80, 82 and the through-holes 60 are aligned with each other, a separate pivot pin 28 is inserted through each of the through-holes 60 in the mounting tabs 38, 40 and into the receptacles 80, 82 as shown in FIG. 4. The pin 28 secures the handle 24 to the actuator plate 26 and also enables the handle 24 to freely pivot relative to the actuator plate 26 between the down position (FIG. 2A) and the up position (FIG. 3A). In order to pivot the actuator plate 26 and cause the cam attached to the actuator plate to engage the drive shaft and release the latch, the first end 70 of the body 68 includes shoulders 84, 86 adjacent to each side 76, 78 of the protruding portion 74, which engage the mounting tabs 38, 40 on the actuator plate 26 when the handle 24 is pivoted to the down position as shown in FIG. 2C. It should be appreciated that the actuator plate 26 and the handle 24 may be made out metal, such as stainless steel, plastic, or any suitable material or combination materials.

In operation, a user pushes down on the handle 24 of the door handle assembly 20 past the down position shown and causes the shoulders 84, 86 at the first end 70 of the door handle 24 to engage the actuator plate 26 where continued pivoting of the handle causes the actuator plate to move in unison with the handle. This pivoting movement causes the cam attached to the actuator plate 26 to engage the drive shaft and release the latch. It should be noted that the present handle 24 operates the latch assembly only when it is in the down position (FIG. 2A). When pivoted to the up position (FIG. 3A), no contact with, or activation of the latch assembly is achieved.

Separating the actuator plate 26 from the door handle 24 and moving the pivot point of the handle to the front of the actuator plate enables the door handle to freely pivot relative to the actuator plate and the cover 30. In this way, the door handle 24 is able to freely move between the down position (FIG. 2A) and the up position (FIG. 3A), thereby allowing the door handle 24 to move easily between positions and to more readily release any clothing or other articles that becomes snagged on or caught on the door handle during use.

Figure 7:
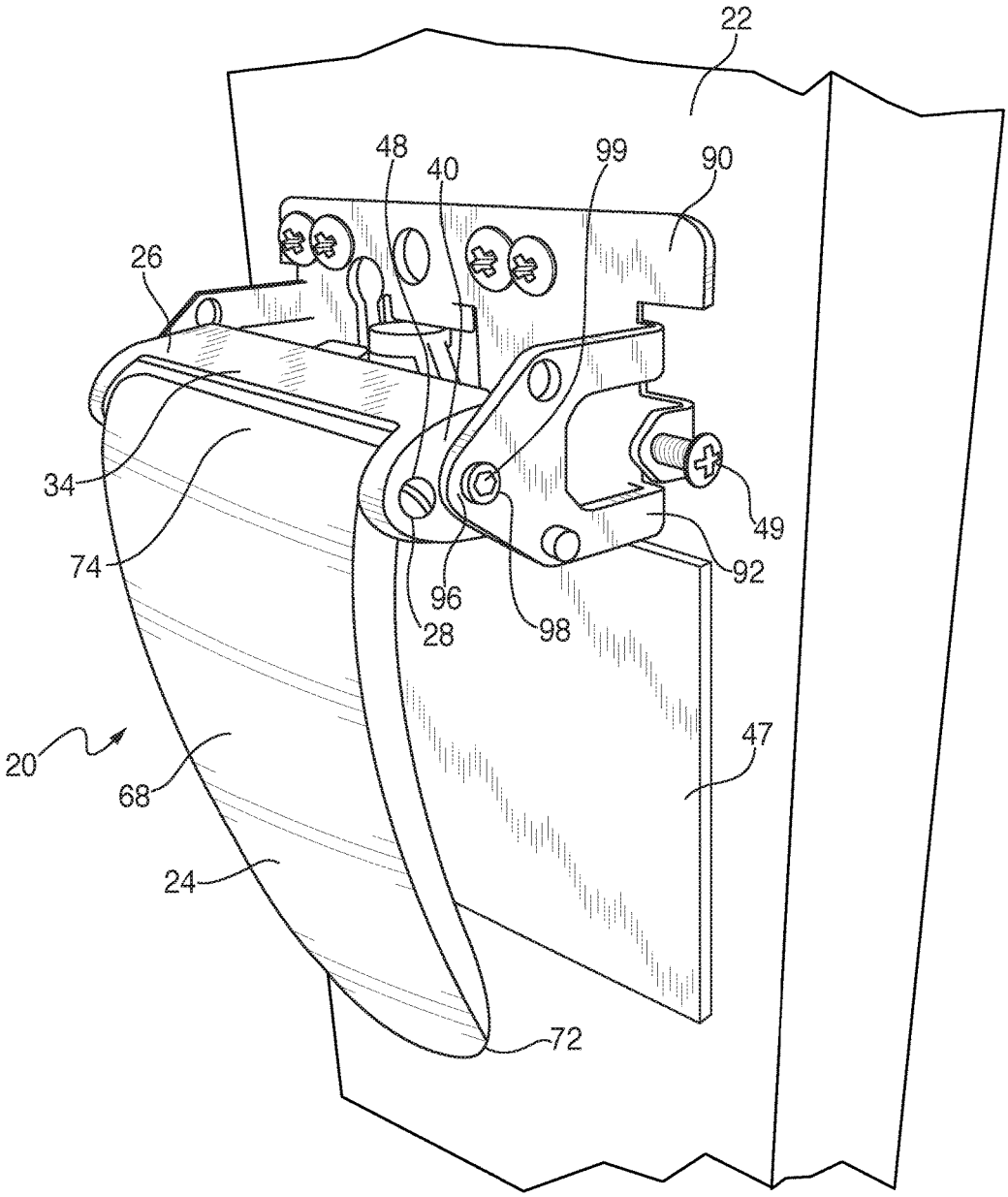
FIG. 7 is a front perspective of the present handle shown mounted to a door with the cover removed.
Figure 8:
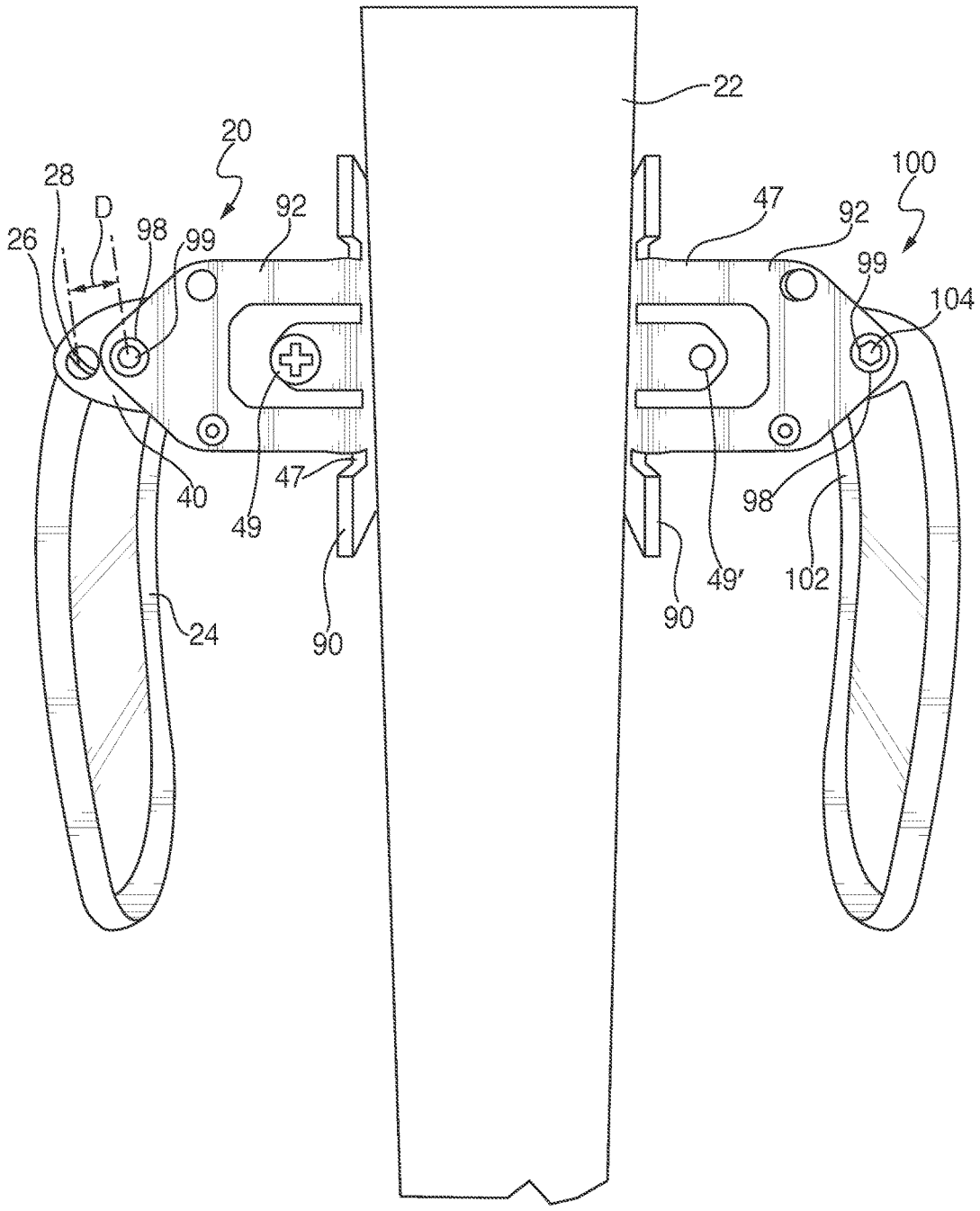
FIG. 8 is a split fragmentary side view of the present handle and latch assembly mounted to one side of a door, and a conventional latch assembly mounted to the other side of the door.

Referring now to FIG. 7, the present door handle assembly 20 is shown mounted to the door 22 with the cover 30 removed. It will be seen that the base 47 includes a flat base plate 90 with generally perpendicularly or forwardly extending arms 92. As is known in the art, the arms 92 are integrally formed with the flat base plate 90. The base 47 is secured to the door 22 via fasteners 94 as is known in the art. Tips 96 of the arms 92 have mounting apertures 98 constructed and arranged for accommodating the fastener openings 48 of the actuator plate 26. The actuator plate 24 is secured to the arms 92 using fasteners 99 as known in the art.

It will be noted that an important feature of the present door handle assembly 20 is constructed and arranged so that the pivot pins 28 of the handle 24 are displaced forwardly of the fastener openings 48 a distance "D" so that upward movement of the handle relative to the base 47 and the cover 30 is not inhibited.

Referring now to FIG. 8, the door 22 is shown with the present latch assembly 20 mounted on the left side, and a conventional latch assembly 100 mounted on the right side. Shared components are indicated with identical reference numbers. It will be seen that in the latch assembly 100, a door handle 102 has a pivot point 104 relative to the base 47 that corresponds to the fastener openings 48. As is known in the art, the latch assembly 100 operates by the handle 102 being pushed toward the door 22. However, no upward movement of the handle 102 is permitted.

In contrast, in the present door assembly 20, the construction of the actuator plate 26 is such that the pivot point represented by the pins 28 is displaced forwardly from the fastener openings 48 the distance "D" which provides sufficient clearance from the base arms 92 as well as from the slot opening 58 in the cover 30 such that the upward pivoting motion of FIG. 3C is more readily achieved.

Thus, the present door assembly 20 is more readily pivoted in an upward direction without engaging the latch mechanism. In this manner, items snagged on the handle 24 are more readily released.

While particular embodiments of the present breakaway latch handle have been described herein, it will be appreciated by those skilled in the art that changes and modifications may be made without departing from the invention in its broader aspects and as set forth in the following claims.

The invention claimed is:

1. A door handle assembly for use with a door, said door handle assembly comprising:

an actuator plate configured for activating a door latch assembly; and a cover including a front opening, an upper edge and a lower edge;

a door handle having a working end pivotally connected to said actuator plate and extending through said front opening of said cover, such that said door handle is pivotal about an axis parallel to a facing surface of the door when said cover is mounted to the facing surface of said door, and said door handle having a free end opposite of said working end configured for manipulation by an operator, wherein said door handle freely pivots between an up position where said free end of said handle extends above the upper edge of said cover, and a down position relative to said actuator plate where said free end extends below said lower edge of said cover, and said door handle only activates said latch assembly via said actuator plate and only when said door handle is in the down position.

2. The door handle assembly of claim 1, wherein said actuator plate has a pair of spaced mounting tabs and said door handle is configured to pivotably engage said mounting tabs.

3. The door handle assembly of claim 2, wherein said mounting tabs each include a through-hole and opposing ends of said door handle each include a receptacle, said through-holes of said mounting tabs are aligned with said receptacles of said door handle and secured together by at least one pivot pin.

4. The door handle assembly of claim 1, wherein said actuator plate includes a pair of mounting tabs defining a space therebetween, and said door handle includes a protruding section configured to be inserted into said space.

5. The door handle assembly of claim 4, wherein said door handle includes opposing shoulders, one of said shoulders being adjacent to each side of said protruding section, each of said shoulders configured to engage said actuator plate when said door handle is moved to the down position.

6. The door handle assembly of claim 1, wherein said actuator plate includes opposing mounting tabs and opposing, parallel, generally horizontal spaced body members extending between said mounting tabs.

7. The door handle assembly of claim 6, further comprising at least two generally vertical supports extending between said body members.

8. A door handle assembly for use with a door, said door handle assembly comprising:

a cover including a front opening, an upper edge and a lower edge;

an actuator plate mounted inside the cover and positioned adjacent to said front opening, wherein said actuator plate is configured for activating a door latch assembly; and a door handle having a working end pivotally connected to said actuator plate and extending through said front opening of said cover, such that said door handle is pivotal about an axis parallel to a facing surface of the door when said cover is mounted to the facing surface of said door, and said door handle having a free end opposite of said working end configured for manipulation by an operator, wherein said door handle freely pivots between an up position where said free end of said handle extends above the upper edge of said cover, and a down position relative to said actuator plate where said free end extends below a lower edge of said cover, and said door handle only activates said latch assembly via said actuator plate and only when said door handle is in the down position.

9. The door handle assembly of claim 8, wherein said actuator plate has a pair of spaced mounting tabs positioned adjacent to said front opening and said door handle is configured to pivotably engage said mounting tabs.

10. The door handle assembly of claim 9, wherein said mounting tabs each include a through-hole and opposing ends of said door handle each include a receptacle, said through-holes of said mounting tabs are aligned with said receptacles of said door handle and secured together by at least one pivot pin.

11. The door handle assembly of claim 8, wherein said actuator plate includes a pair of mounting tabs defining a space therebetween, and said door handle includes a protruding section configured to be inserted into said space.

12. The door handle assembly of claim 11, wherein said door handle includes opposing shoulders, one of said shoulders being adjacent to each side of said protruding section, each of said shoulders configured to engage said actuator plate when said door handle is moved to the down position.

13. The door handle assembly of claim 8, wherein said actuator plate includes opposing mounting tabs and opposing, parallel spaced generally horizontal body members extending between said mounting tabs.

14. The door handle assembly of claim 13, further comprising at least two supports extending generally vertically between said body members.

15. A door handle assembly for use in operating a door latch in a door, said door handle assembly comprising:

a base having a flat plate and a pair of forwardly projecting arms, each said arm having a mounting aperture;

a cover including a front opening, an upper edge and a lower edge;

an actuator plate mountable between said arms and having fastener openings engaging said mounting apertures, said actuator plate configured for activating the door latch; and a door handle having a working end pivotally connected to said actuator plate at a pivot point displaced from said fastener openings, said working end of said door handle extending through said front opening of said cover, such that said door handle is pivotal about an axis parallel to a facing surface of the door when said cover is mounted to the facing surface of said door, and said door handle having a free end opposite of said working end configured for manipulation by an operator, wherein said door handle freely pivots between an up position where said free end of said handle extends above the upper edge of said coven and a down position relative to said actuator plate where said free end extends below a lower edge of said cover and said door handle only activates said latch assembly via said actuator plate and only when said door handle is in the down position.

* * * * *